US005119650A

United States Patent [19]

Lo

[11] Patent Number: 5,119,650

[45] Date of Patent: Jun. 9, 1992

[54] COMBINATION PADLOCK WITH RE-SETTING MECHANISM

[76] Inventor: Tzung-I Lo, P.O. Box 96-405, Taipei 10098, Taiwan

[21] Appl. No.: 751,098

[22] Filed: Aug. 28, 1991

[51] Int. Cl.[5] ..... E05B 37/02

[52] U.S. Cl. ..... 70/25

[58] Field of Search ..... 70/22, 24-28

[56] References Cited

U.S. PATENT DOCUMENTS

| | | | |
|---|---|---|---|
| 1,226,895 | 5/1917 | Landeen | 70/26 |
| 1,857,399 | 5/1932 | Piagneri | 70/28 |
| 2,830,447 | 4/1958 | Miller | 70/25 |
| 3,817,063 | 6/1974 | Williams | 70/24 |
| 4,615,191 | 10/1986 | Grandy | 70/26 |
| 5,005,384 | 4/1991 | Lo et al. | 70/25 |

FOREIGN PATENT DOCUMENTS

| | | | |
|---|---|---|---|
| 412633 | 1/1946 | Italy | 70/28 |

*Primary Examiner*—Lloyd A. Gall

[57] ABSTRACT

A combination padlock with re-setting mechanism, which comprises a main shaft having a shaft end block on one end and a shaft portion on the other end thereof; the shaft portion has an axial hole with cascade-shaped hole therein and a long slot on the top side thereof for receiving a positioning rod and a locking bar; a spring is mounted between the locking tumbler and the positioning rod; springs are also mounted between the locking bar and the positioning rod. The shaft portion is mounted around with several clutch rings and resilient partition rings. After the main shaft and the fixed cap are assembled together, the positioning rod is fixed in place with a fixing pin; the fixed cap has a shackle hole for receiving one end of a shackle. The outer surface of the main shaft is mounted with several wheel members; the shaft end block of the main shaft and the movable cap are detachable so as to facilitate changing the combination numbers by removing all the wheel members to set new combination numbers thereon.

10 Claims, 6 Drawing Sheets

COMBINATION PADLOCK WITH RE-SETTING MECHANISM

BACKGROUND OF THE INVENTION

1. Field of the Invention

This invention relates to a combination padlock, and particularly to a combination padlock with re-setting mechanism for changing the combination if necessary.

2. Description of the Prior Art

In the prior art, such as U.S. Pat. No. 3,817,063, the combination padlock has a set of combination wheels mounted on a shaft portion on one end of the padlock; the shaft portion has a T-shaped groove to receive a T-shaped locking bar; a spring is mounted between the locking bar and the T-shaped groove. The center of the shaft portion has a round hole for receiving two locking tumblers, between which there is a spring to provide an outward pushing force to the same. A set of combination wheels and a fastening sleeve are mounted on the shaft portion. The combination padlock can be put in locked or unlocked position by means of two locking tumblers, a spring between the tumblers, a T-shaped locking bar, and a set of combination wheels.

The aforesaid prior art is deemed not convenient in operation than a dial type of combination padlock because of only a small part of the combination wheels being exposed to operation, and the wheels having no sufficient width.

In another U.S. Pat. No. 4,615,191, a barrel combination lock, the lock has a steel cable shackle, of which one end has ball grooves 39*a* to 39*d*, while the other end thereof has a cable sleeve 21. The cable sleeve 21 and the cap 12 are fixedly attached to one end of the shaft body 13, of which the other end is mounted with a removable end cap 18. The center of the shaft body has an axial hole. One end of the shaft body has several ball holes for receiving several locking balls respectively. Several clutches 14 are mounted around the shaft body; the inner surface of each clutch has several locking ball recesses to be in alignment with the ball holes. The outer surface of each of the clutches is mounted and engaged with a combination wheel by means of projections and recesses thereof. All the combination wheels and clutches are maintained in place with a removable end cap. When the combination lock is in lock-up position, one end of the cable shackle with ball grooves 39*a*–39*d* is retained in the axial hole of the shaft body by the locking balls in the ball holes respectively. Before the combination wheels are aligned with the combination numbers set, the locking ball recesses of the clutches are unable to receive the locking balls, i.e., the end with ball grooves is unable to pull out of the lock. When the combination wheels are set at the correct combination numbers, the ball recesses of the clutches are in alignment with the well holes respectively; then, when the ball groove end is pulled out, the locking balls will be moved towards the ball recesses. After the shockle is pulled out, the end cap engaged with the shaft body can be disengaged from each other; the end cap can be moved off along the L-shaped sleeve groove of the shaft body. As soon as the end cap is removed, all the combination wheels can be removed. The combination numbers of the lock may be changed by re-setting the numbers.

The shaft hole of the aforesaid combination lock can only be used for locking up or releasing the shackle end in place by means of the well holes on the shaft body engaged with the locking balls. The structure of the lock is unable to be used in a padlock; further, the coupling structure between the shaft body and the end cap is unable to be used in a padlock.

In another U.S. Pat. No. 5,005,384, the combination padlock is an invention of the present applicant with another person. The prime structure of the padlock comprises a main shaft to be mounted around with a set of combination wheels; the main shaft has a T-shaped slot for receiving a T-shaped block with springs between them. The main shaft has a center hole for mounting two locking tumblers, between which a spring is installed so as to provide the tumblers with a pushing out force. After the main shaft is mounted with the combination wheels and an end cap, the padlock can be used for lock-up or unlocking function by means of the structure among the two locking tumblers, the T-shaped block and T-shaped slot.

In the aforesaid invention, the applicant has discovered that the padlock still has a drawback of inconvenience upon being commercialized, i.e., the change of combination numbers can only be done by using a screwdriver to remove an internal screw first before removing the cap off the lock.

SUMMARY OF THE INVENTION

In view of the drawbacks of the aforesaid combination locks, the applicant has developed a new combination padlock, which can be used as a U-shaped shackle padlock or a steel cable shackle lock. To change the combination numbers, a user should unlock the padlock first, and then pull the movable cap off to remove all the wheel members. The combination numbers can be changed, and then restore all the wheel members in place to set the padlock in normal operation condition.

The prime object of the present invention is to provide a combination padlock in which the axial hole in the main shaft has a cascade-shaped hole and a long slot on the upper side of the axial hole. The cascade-shaped hole is used for receiving a locking tumbler. The axial hole is to receive a positioning rod, while the long slot is to receive a locking bar. The shaft portion of the main shaft is mounted with several clutch rings and resilient partition rings. One end of the main shaft is fixed in a socket of the fixed cap, while other end of the main shaft is coupled with the block socket of the movable cap; the outer surface of the clutch rings are mounted with several corresponding wheel members. To change the combination numbers, the movable cap should first be removed, and then all the wheel members are to be moved off the main shaft for re-setting the combination numbers; finally, mount all the wheel members back to the main shaft.

Another object of the present invention is to provide a combination padlock, in which the axial hole of the main shaft is fixedly mounted with a positioning rod. Before the positioning rod is mounted in place, a locking tumbler should be inserted in a cascade-shaped hole. A spring element is mounted between the locking tumbler and the positioning rod so as to provide the locking tumbler with a pushing outward force.

Still another object of the present invention is to provide a combination padlock, in which the positioning bar is fixedly mounted in the axial hole of the main shaft; the top side of the positioning bar has a retaining groove for mounting a locking bar; at least two springs are installed between the positioning bar and locking bar. When the combination padlock is in lock-up position, the locking bar is sitting in the retaining groove to have the same curved surface as that of the shaft portion. The locking bar is used for controlling the movement of the locking tumbler upon the combination padlock being unlocked or locked up.

A further object of the present invention is to provide a combination padlock, in which one end of the main shaft has a shaft end block to be connected together with the movable cap; the outer diameter of the shaft end block is larger than that of the shaft portion on other end thereof. The shaft portion is to be mounted with several clutch rings and several resilient partition rings. The end of the shaft portion is connected with the socket of the fixed cap. The clutch rings and parts in the axial hole are used for controlling the unlocking or lock-up operation of the combination padlock.

A still further object of the present invention is to provide a combination padlock, in which the connected portion between the main shaft and the movable cap have two corresponding flat surfaces; the bottom side of the shaft end block has a positioning hole, while the bottom of the movable cap has a round hole with a ball socket for receiving a ball and a spring. By means of the ball on the ball socket, the main shaft and the movable cap can be connected together in a resilient manner between the positioning hole of the main shaft and the ball socket of the movable cap.

DETAILED DESCRIPTION OF THE PREFERRED EMBODIMENT

Figure 2:
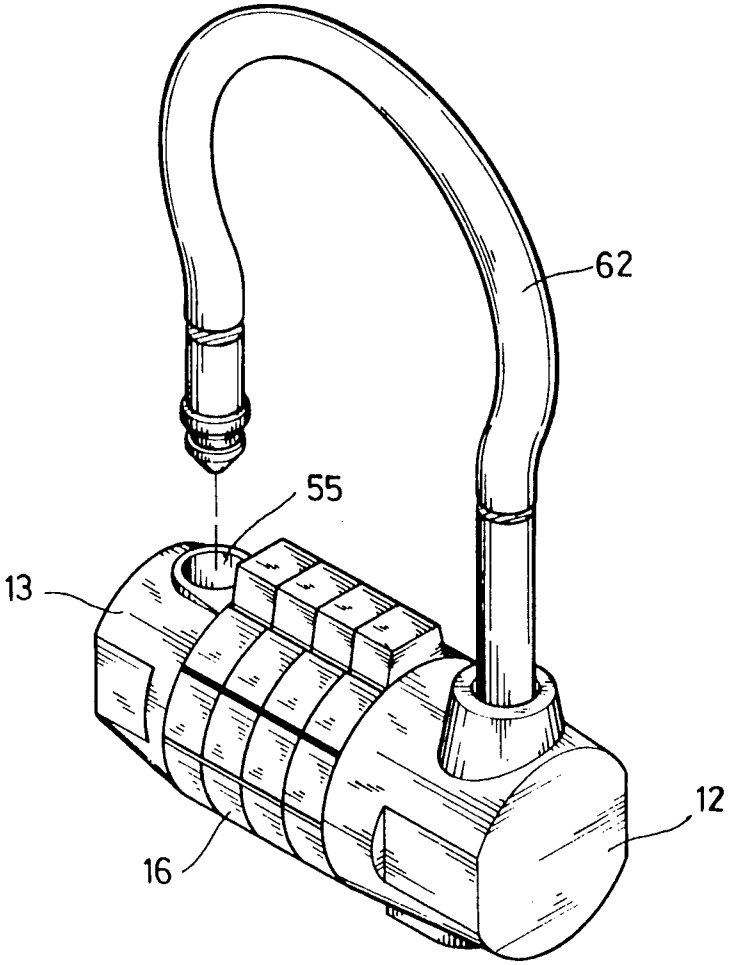
FIG. 2 is a perspective view of an embodiment according to the present invention with a steel cable shackle.
Figure 1:
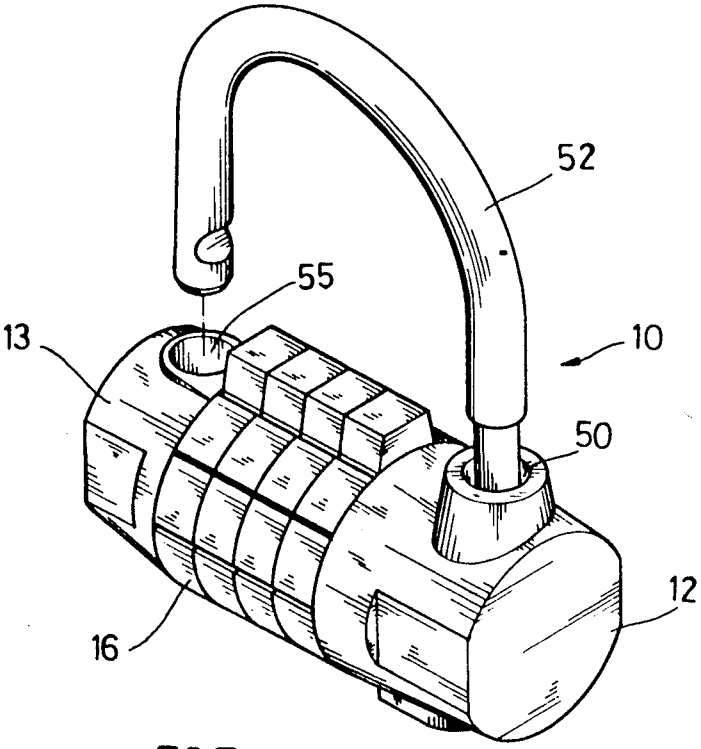
FIG. 1 is a perspective view of an embodiment according to the present invention with a U-shaped shackle.

The embodiment according to the present invention is a barrel combination lock, of which the combination may be changed, if necessary. As shown in FIG. 1, the combination padlock has a U-shaped shackle 52 to facilitate the lock to fasten to an object to be locked up. FIG. 2 shows the present invention has a steel cable shackle 62. The padlock according to the present invention has a plurality of wheel members 16 to be mounted pivotally between a fixed cap 12 and a movable cap 13; together with other inner parts, the padlock can be unlocked or locked on a given object.

Figure 3:
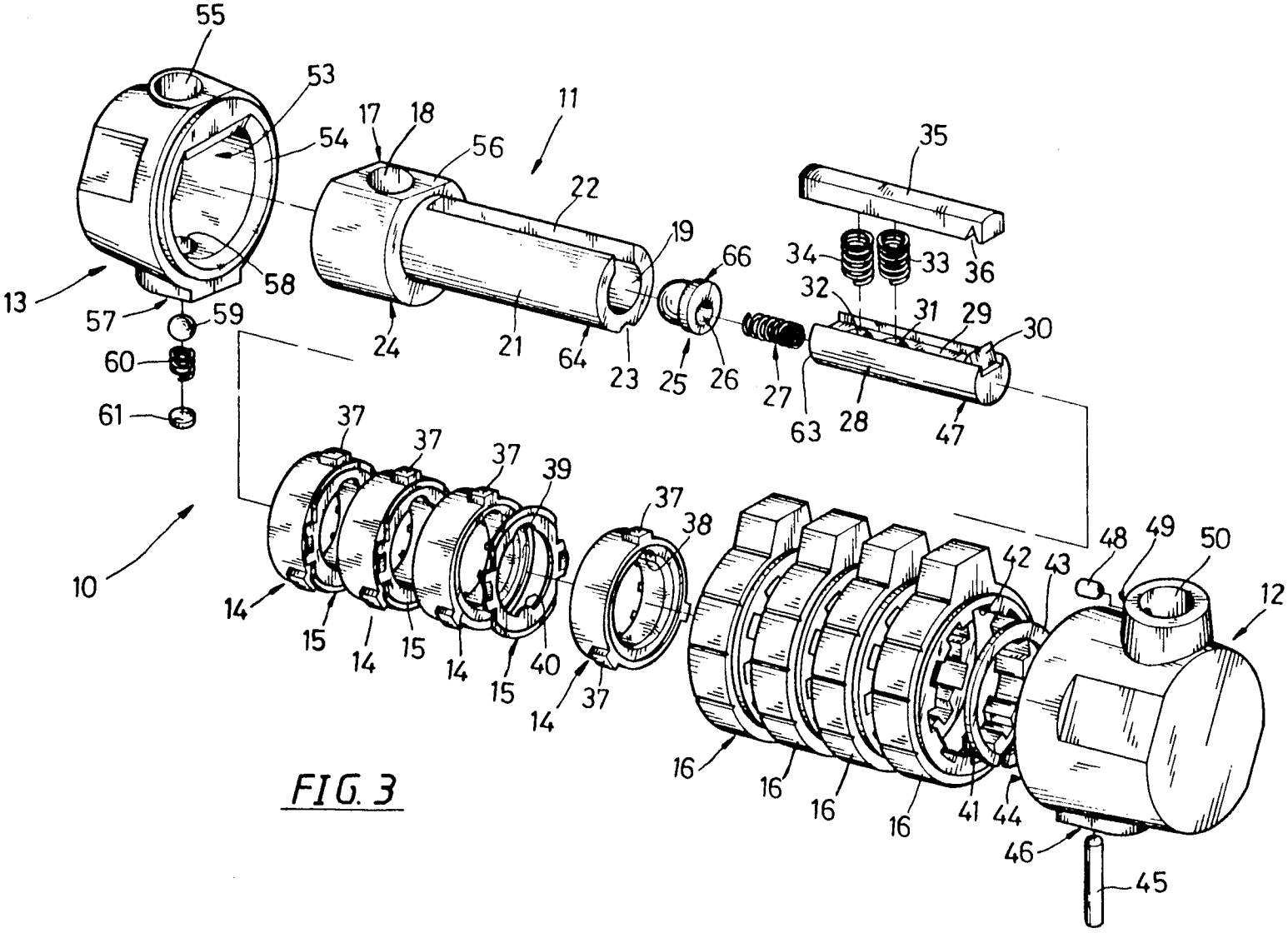
FIG. 3 is a disassembled view of the embodiment according to the present invention.
Figure 4:
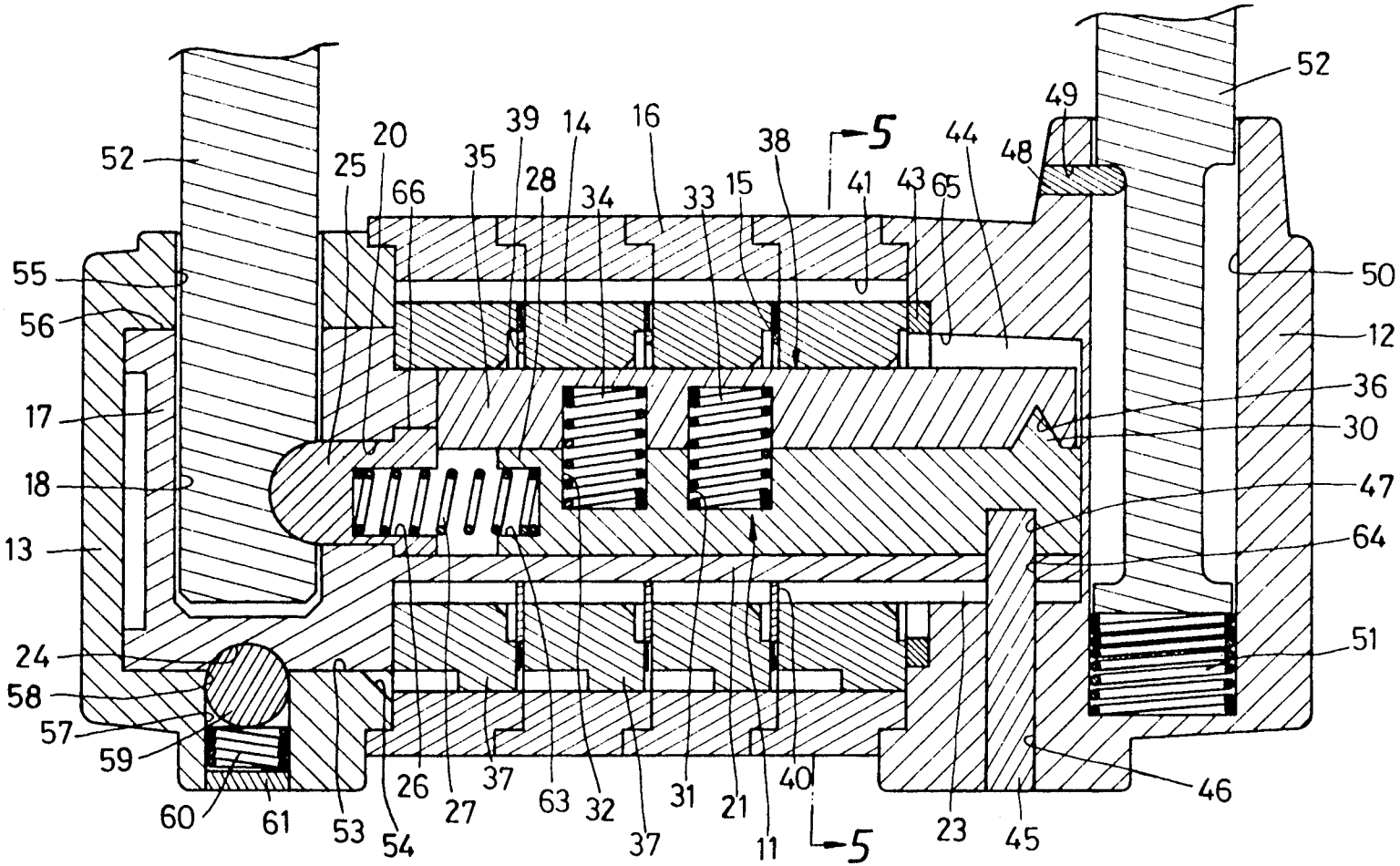
FIG. 4 is a sectional view of the present invention, being in lock-up condition.

The present invention is described in the following paragraphs with the embodiment having a U-shaped shackle as shown in FIGS. 1, 3 and 4; the inner parts of the padlock according to the present invention includes a main shaft 11 which has a shaft portion 21 and a shaft end block 17. The shaft end block 17 has a flat surface 56 with a shackle hole 18; a movable cap 13 is to be mounted around the shaft end block 17. The shaft portion 21 has a small diameter than that of the shaft end block 17; several clutch rings 14 and resilient partition rings 15 are mounted around the shaft portion 21. The shaft portion 21 has an axial hole 19 and a long slot 22 on the top side thereof. A positioning rod 28 is inserted in the axial hole 19. The long slot 22 is to be mounted with a locking bar 35. The axial hole 19 is in communication with the shackle hole 18. A part of the axial hole 19 nearing the shackle hole 18 has a cascade-shaped hole 20 for receiving a locking tumbler 25, which is used for controlling the U-shaped shackle 52 in lock-up and unlocked condition.

The locking tumbler 25 is mounted movably in the cascade-shaped hole 20; the semi-spheric part of the locking tumbler 25 is to be mated with the shackle hole 18. The cascade-shaped hole 20 has a function to limit the locking tumbler 25 to move towards the shackle hole 18 at a suitable distance; the other end of the locking tumbler 25 has a round hole 26 for receiving a spring 27. After the locking tumbler 25 is mounted is in the cascade-shaped hole 20, the positioning rod 28 is inserted in the axial hole 19; one end of the positioning rod 28 nearing the locking tumbler 25 has a round hole 63 for mounting a spring 27 between the positioning rod 28 and the locking tumbler 25. The positioning rod 28 is permanently fixed in the main shaft 11, and therefore the locking tumbler 25 is also mounted permanently and movably in the cascade-shaped hole 20 in a space provided with the spring 27. The locking tumbler 25 can be moved back and forth upon the U-shaped shackle 52 being pulled out or inserted in the shackle hole 18, and the locking tumbler 25 is always loaded with a spring 27 to maintain in a pushing-out condition.

The positioning rod 28 to be installed in the axial hole 19 of the main shaft 11 has a retaining groove 29, which is facing and coincided with the long slot 22. The retaining groove 29 is to receive a locking bar 35, and the retaining groove 29 has two round holes 31 and 32 for receiving two springs 33 and 34 respectively; the top ends of the two springs 33 and 34 are mated with two holes respectively under the locking bar 35 so as to provide the locking bar 35 with a pushing-up force. One end of the retaining groove 29 has a positioning block 30 to be mated with a positioning recess 36, whereby the combination padlock 10 can be remained in lock-up condition without moving.

After the positioning rod 28 and the locking bar 35 are mounted in the axial hole 19 and the long slot 22, the clutch rings 14 and the resilient partition rings 15 are mounted around the shaft portion 21 of the main shaft 11; each of the resilient partition rings 15 is sandwiched between two clutch rings 14 so as to provide a resilient contact among them. The inner diameter of the resilient partition rings 15 is just large enough to mount around the shaft portion 21. The inner surface of the clutch rings 14 has an inner recess 38 to be mated with the upper surface of the locking bar 35; when the combination padlock is set in unlocked condition, the upper surface is just mated with the inner recess 38. The outer surface of each of the clutch rings 14 is furnished with several coupling projections 37, which are to be engaged with the inner projections 41 of the wheel members 16 upon the wheel members being mounted around the clutch rings 14 respectively.

On the shaft portion 21, each of the resilient partition rings 15 is sandwiched between two clutch rings 14; each of the resilient partition rings 15 is fixedly mounted around the shaft portion 21 by means of a round groove 23 under the shaft portion 21 and a semi-circular lug 40 in the lower inner surface of each of the resilient partition rings 15. After the clutch rings 14 and the resilient partition rings 15 are mounted on the shaft portion 21, the resilient partition rings 15 can provide a suitable resilience upon the clutch rings 14 being driven to move by the wheel members 16.

The inner surface of each of the clutch rings 14 has an inner recess 38 which is to receive the locking bar 35 upon the combination padlock being unlocked. The upper inner surface of each of the resilient partition rings 15 also has an inner recess 39 for receiving the locking bar 35 lifted upon the combination padlock 10 being unlocked.

After all the clutch rings 14 and the resilient partition rings 15 are mounted on the shaft portion 21, a resilient washer 43 is to be mounted at the end thereof before the end of the shaft portion 21 being fixed in a socket 44 of a fixed cap 12. The lower side of the fixed cap 12 has a pin hole 46 for receiving a fixing pin 45, which is to be inserted into a pin hole 64 under the shaft portion 21 and a pin hole 47 under the positioning rod 28 so as to have the main shaft 11, the fixed cap 12 and the positioning rod 28 fastened together. Since there is a resilient washer 43 being mounted beside the clutch rings 14 on the shaft portion 21, all the clutch rings 14 are set in a resilient and close contact condition during rotation.

After the shaft portion 21 of the main shaft 11 is fixed in the socket 44 of the fixed cap 12, the locking bar 35 in the long slot 22 of the main shaft 11 can be moved up and down freely within a given space. A curved recess 65 is furnished in the socket 44 as a hollow space for the locking bar 35 to move. The fixed cap 12 has a shackle hole 50 with a spring 51 for receiving a U-shaped shackle 52 end having a smaller diameter. After the end of the U-shaped shackle 52 is inserted in the shackle hole 50, a positioning pin 48 is inserted in a pin hole 49 so as to retain the U-shaped shackle 52 in the fixed cap 12 in a movable manner.

The unlocking and locking condition of the combination padlock 10 depend on the numbers aligned with the wheel members 16. When the padlock is in unlocked condition, all the inner recesses 38 of the clutch rings 14 are aligned over the long slot 22, and the locking bar 35 would automatically move upwards as a result of the pushing force of springs 33 and 34. As soon as the locking bar 35 moves upwards, the locking tumbler 25 will have a given space to move back and forth; then, the U-shaped shackle 52 can be pulled out freely. Whenever any one of the wheel member 16 is set at a wrong combination number, the inner recess 38 of the clutch ring 14 will not be aligned will the long slot 22; in that case, the locking bar 35 will be unable to move upwards, and the padlock remains in lock-up condition. Each of the wheel members 16 has a numerical face, inner projections 41 and inner grooves 42, which are to be engaged with the coupling projections 37 of the clutch rings 14 so as to have clutch rings 14 driven to move by the moving of the wheel members 16.

The wheel members 16 are to be mounted on the main shaft 11 via the shaft end block 17, and then the movable cap 13 is mounted over the shaft end block 17. The movable cap 13 has a block socket 53 for receiving the main shaft 11 with a positioning hole 24. By means of the block socket 53, the movable cap 13 and the main shaft 11 can be assembled together. The block socket 53 has a bevel edge 54. The shaft end block 17 has a flat surface 56 to be mated with a flat surface in the block socket 53 for positioning purpose between them. The top side of the movable cap 13 has a round hole 55 to be aligned with the shackle hole 18 for receiving the U-shaped shackle 52.

After the movable cap 13 and the main shaft 11 are assembled together, the wheel members 16 can be mounted in place, and the U-shaped shackle 52 can also be inserted in the shackle hole. The movable cap 13 can be assembled together with the main shaft 11, and can be disassembled therefrom easily. The bottom part of the movable cap 13 has a round hole 57 and a ball socket 58 for receiving a ball 59 and a spring 60; the bottom of the round hole is to be closed with a plug 61. The spring 60 in the round hole 57 will provide a pushing force to push the ball 59 upwards into the block socket 53 until being stopped with a positioning hole 24 in the shaft end block 17 so as to provide a positioning function between the movable cap 13 and the main shaft 11.

Figure 8:
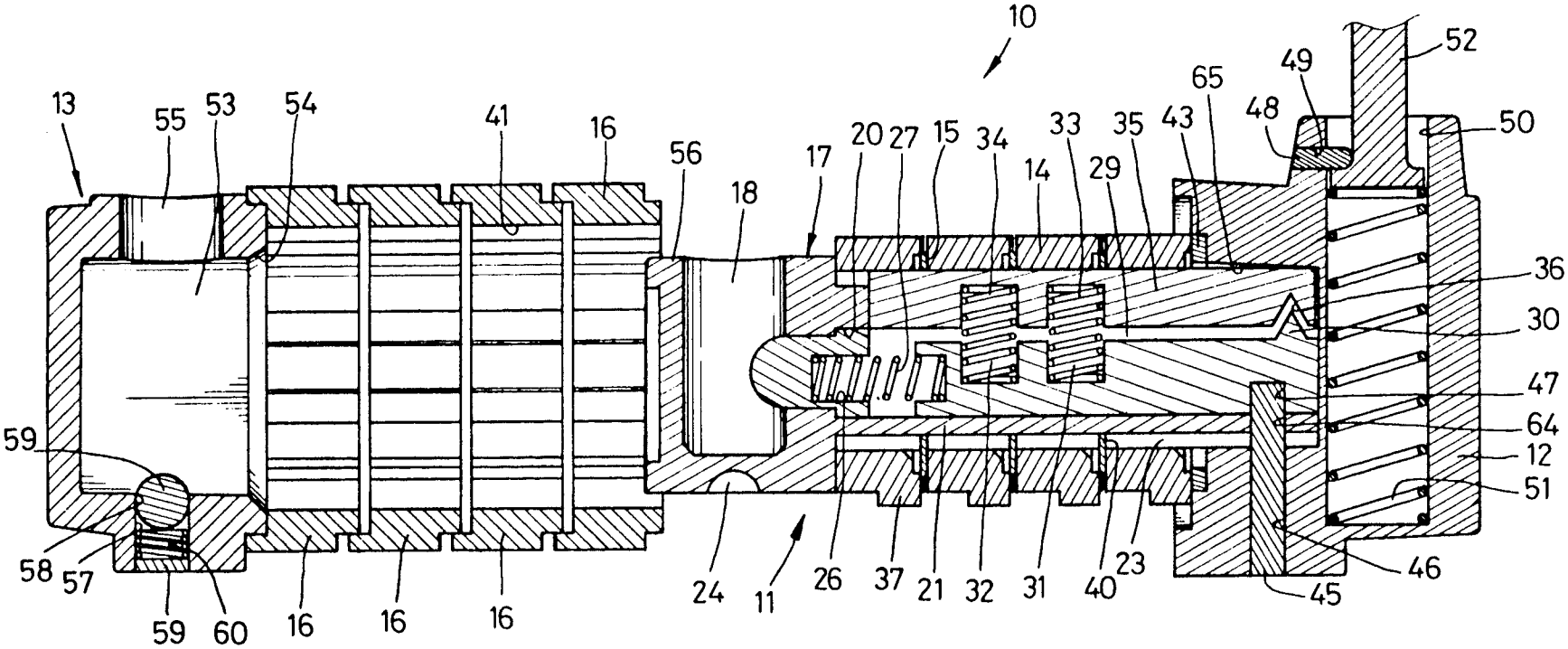
FIG. 8 is a sectional view of the present invention, showing the wheel members being pulled out from the main shaft of the padlock.

In the present invention, the U-shaped shackle 52 can be set in lock-up or unlocked position as shown in FIGS. 4 and 8 by means of the locking tumbler 25 mounted in a cascade-shaped hole 20 of the axial hole 19 in the main shaft 11; the locking tumbler 25 is normally under a pushing-out condition towards the shackle hole 18 as a result of a spring 27. When the main shaft 11 is set in lock-up condition, the locking bar 35 is pressed downwards to such an extent that it would push against the rear end of the locking tumbler 25 to prevent the locking tumbler 25 from moving backwards; then, the U-shaped shackle 52 will be retained in the shackle hole 18 without being pulled out; likewise, the U-shaped shackle 52 is also unable to insert in the shackle hole 18 to set the padlock in lock-up condition except the combination being set in an unlocked position through the wheel members 16; in that case, the inner recesses 38 of the clutch rings 14 will be positioned over the long slot 22, and the locking bar 35 will be pushed, by springs 34 and 35, into the inner recesses 38 of the clutch rings 14, and the locking tumbler 25 can be moved freely so as to have the U-shaped shackle 52 pushed into lock-up condition, or pulled out. The moving space of the locking tumbler 25 is shown clearly in FIG. 8.

Figure 5:
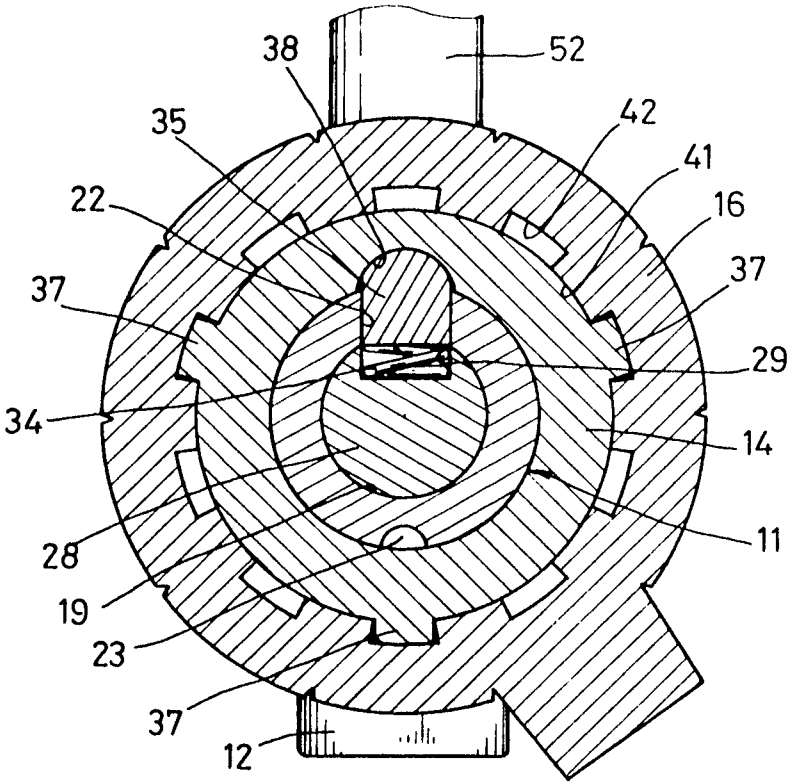
FIG. 5 is a sectional view of the present invention taken along line 5—5 in FIG. 4, being in unlocked condition.

When the combination padlock 10 is set in unlocked condition as shown in FIGS. 3 to 5, the clutch rings 14 are already driven by the wheel members 16 to unlocked position; all the inner recesses 38 of the clutch rings 14 are set over the long slot 22 of the shaft portion 21, and the locking bar 35 will be pushed, by springs 33 and 34, in the inner recesses 38; the cascade flange 66 of the locking tumbler 25 is set in disengaged condition from the lower edge of the locking bar 35. When the U-shaped shackle 52 is moved within the round hole 55 of the movable cap 13, the locking tumbler 25 will be pushed to move freely to facilitate the U-shaped shackle 52 to insert in or pull out.

Figure 6:
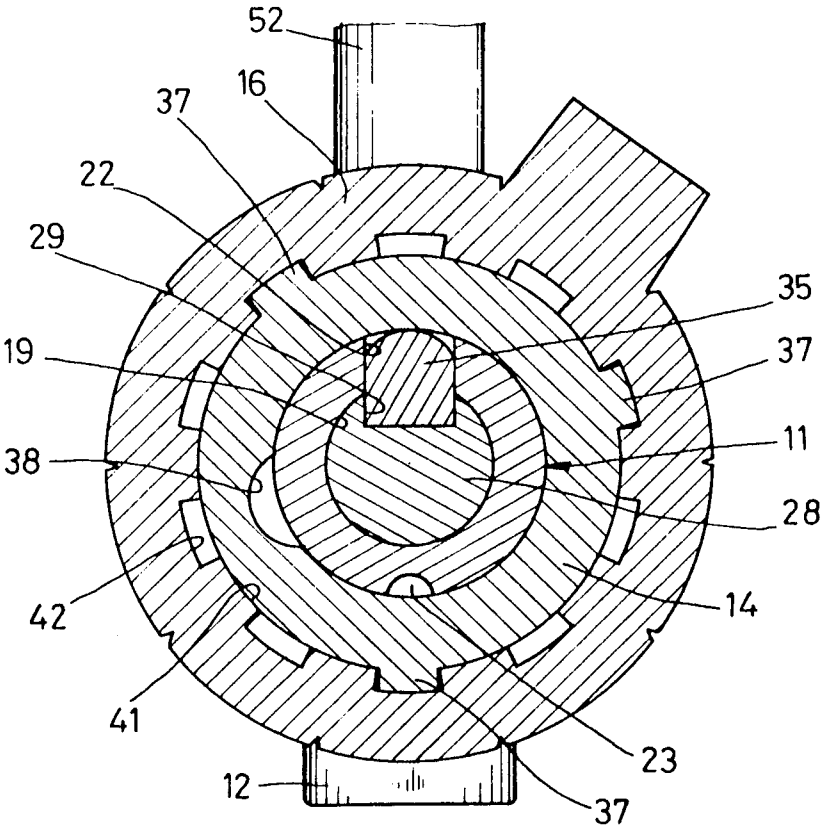
FIG. 6 is a sectional view of the present invention taken along line 5—5 in FIG. 4, being in lock-up condition.
Figure 7:
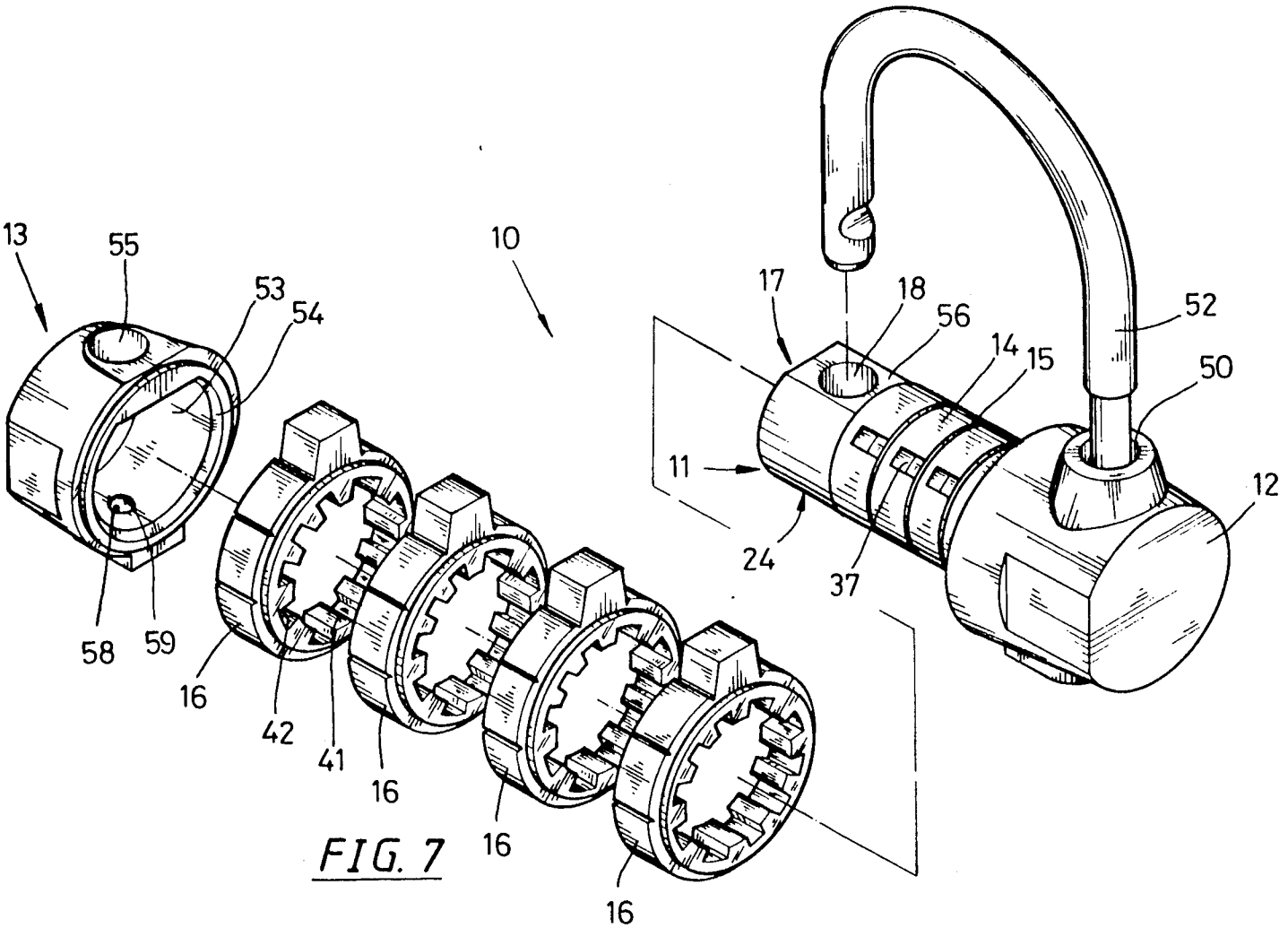
FIG. 7 is a disassembled view of the present invention, showing the wheel members having been pulled out of the main shaft of the padlock.

The numbers of the combination padlock according to the present invention may be changed by first changing the padlock from lock-up condition (as shown in FIGS. 4 and 6) into unlocked condition (as shown in FIG. 5), i.e., the inner recesses 38 of all the clutch rings 14 are aligned over the long slot 22 of the main shaft 11, and the locking tumbler 25 is in a freely moving condition so as to release the U-shaped shackle 52 to be pulled out of shackle hole 18 freely as shown in FIG. 1; then, the series of combination numbers of the padlock can be changed as shown in FIGS. 7 and 8 by pulling out the movable cap 13 and the wheel members 16 subsequently; the numbers of the wheel members 16 can then be re-set over the clutch rings 14 until the coupling projections 37 of the clutch rings 14 being engaged with the inner projections 41 of the wheel members 16; then, the movable cap 13 is mounted together with the shaft end block 17 of the main shaft 11 again, and the positioning hole 24 of the main shaft 11 is assembled together with the ball 59 of the movable cap 13; the change of combination is done.

After the present invention is assembled, the U-shaped shackle 52 can be inserted into the movable cap 13 again for normal lock-up operation. The combination can be changed any time if necessary, since the changing steps are simple and easy.

The present invention has been described in detail by means of the aforesaid embodiment that has a U-shaped shackle 52. It is understood that the U-shaped shackle may be replaced with a steel cable shackle 62 as shown in FIG. 2. The rest parts of the present invention remain unchanged, and therefor no further description thereof is given.

According to the description on the aforesaid embodiment of the present invention, the present invention is deemed a best improvement to the conventional combination padlock, being practical and novel in structure. Of course, any similar modification or change by a person skilled in the art to the present invention would be considered within the scope of the claims of the present invention.

I claim:

1. A combination padlock with re-setting mechanism comprising:

a main shaft including a shaft end block at one end thereof and a shaft portion at the other end thereof, and said shaft end block having a larger outer diameter than that of said shaft portion, and a top side of said shaft end block having a flat surface and a shackle hole; said shaft portion having an axial hole and a long slot being in communication with said axial hole and said shackle hole;

a locking tumbler being installed in said axial hole of said main shaft, and one end thereof being a semi-spheric ball, while the other end thereof being a cascade flange;

a positioning rod being installed in said axial hole, and an upper side thereof having a retaining groove and a positioning block; and spring elements mounted between said upper side of said positioning rod and a locking bar;

said locking bar being mounted in said long slot and over said positioning rod;

several clutch rings being mounted around said shaft portion of said main shaft, each of said clutch rings having an inner recess and several coupling projections on an outer surface thereof;

several resilient partition rings, each of which being installed on said shaft portion between two said clutch rings; and each of said resilient partition rings having an inner recess over said long slot of said shaft portion, and said inner recess being the same as that of said clutch ring;

a movable cap having a block socket to be mated with said shaft end block of said main shaft and having a round hole over said shackle hole, and a ball socket at a bottom side of said movable cap for mounting therein a ball, a spring, and a plug;

a fixed cap having a socket for receiving said shaft portion to be fixed in place with a fixing pin, a shackle hole on the top side thereof for receiving one end of a U-shaped shackle;

several wheel members mounted around said clutch rings, and having inner projections to be engaged with said coupling projections on said clutch rings; and when said wheel members drive said clutch rings to rotate, said locking bar being moved in said long slot to cause said combination padlock to be locked up; and when said padlock being unlocked, said inner recesses of said clutch rings being over said long slot of said main shaft to give way to said locking bar to move upwards until entering said inner recesses of said clutch rings so as to have said locking tumbler moved freely such that said padlock is unlocked freely.

2. A combination padlock with re-setting mechanism as claimed in claim 1, wherein said shackle hole of said fixed cap receives a longer end of said U-shaped shackle, and limiting said U-shaped shackle from pulling out of said shackle hole; and said round hole of said movable cap being in communication with said shackle hole of said main shaft, and a short end of U-shaped shackle being inserted through said round hole, and said U-shaped shackle being engageable by said locking tumbler.

3. A combination padlock with re-setting mechanism as claimed in claim 1, wherein said shackle hole of said fixed cap is mounted with a steel cable shackle, while said round hole of said movable cap receives another end of said steel cable shackle, which is engageable by said locking tumbler.

4. A combination padlock with re-setting mechanism as claimed in claim 1, wherein a lower side of said main shaft has a round groove to be mated with semi-circular lugs of said resilient partition rings upon said resilient partition rings being mounted on said shaft portion so as to have said inner recesses of said resilient partition rings maintained right over said long slot of said main shaft.

5. A combination padlock with re-setting mechanism as claimed in claim 1, wherein a cascade-shaped hole is provided between said axial hole and said shackle hole of said main shaft for the purpose of limiting and guiding said locking tumbler to move therein.

6. A combination padlock with re-setting mechanism as claimed in claim 1, wherein said locking tumbler is movably installed in said cascade-shaped hole in said shaft portion; and said cascade flange has a round hole for receiving a spring so as to maintain said locking tumbler in said cascade-shaped hole.

7. A combination padlock with resetting mechanism as claimed in claim 1, wherein a positioning recess at one end of said locking bar being at a corresponding and opposite position of said positioning block of said positioning rod so as to provide said locking bar with a definite position to rest upon moving down.

8. A combination padlock with re-setting mechanism as claimed in claim 1, wherein a resilient washer is installed between said socket of said fixed cap and said clutch rings so as to maintain said clutch rings in a resilient condition during rotating.

9. A combination padlock with re-setting mechanism as claimed in claim 1, wherein said ball in said ball socket being mated with a positioning hole in said shaft end block upon said main shaft being assembled together with said movable cap.

10. A combination padlock with re-setting mechanism as claimed in claim 1, wherein said wheel members being engaged with clutch rings by means of said inner grooves defined by said inner projections and said coupling projections of said clutch rings; and said wheel members being mounted between said fixed cap and said movable cap, and upon said movable cap being removed, said wheel members are also removable.

* * * * *